United States Patent [19]

Casso

[11] Patent Number: 4,976,143

[45] Date of Patent: Dec. 11, 1990

[54] SYSTEM AND METHOD FOR MONITORING DRILL BIT DEPTH

[75] Inventor: Christopher G. Casso, Sugar Land, Tex.

[73] Assignee: Anadrill, Inc., Sugar Land, Tex.

[21] Appl. No.: 417,174

[22] Filed: Oct. 4, 1989

[51] Int. Cl.[5] ..... E21B 45/00

[52] U.S. Cl. ..... 73/151.5

[58] Field of Search ..... 73/151, 151.5

[56] References Cited

U.S. PATENT DOCUMENTS

| | | |
|---|---|---|
| 2,166,212 | 7/1939 | Hayward . |
| 2,221,767 | 11/1940 | Hayward et al. . |
| 2,287,819 | 6/1942 | Nichols . |
| 3,651,871 | 3/1972 | Greene . |
| 3,853,004 | 12/1974 | Westlake et al. . |
| 3,931,735 | 1/1976 | Guigmard . |
| 4,114,435 | 9/1978 | Patton et al. . |
| 4,312,223 | 1/1982 | Koch . |
| 4,338,565 | 7/1982 | Hall . |
| 4,610,005 | 9/1986 | Utasi . |
| 4,616,321 | 10/1986 | Chan . |
| 4,756,188 | 7/1988 | Fennell . |
| 4,787,244 | 11/1988 | Mikolajczk . |

*Primary Examiner*—Robert Raevis

*Attorney, Agent, or Firm*—John J. Ryberg; David P. Gordon

[57] ABSTRACT

Methods and apparatus for accurately determining drill bit depth are provided. A hook load is sampled at a rate of at least 4 Hz and is compared to a low threshold to establish a slips-in condition. A determination is made retroactively that the drill string stopped moving when the hook load passed through a high dynamic threshold. On the slips-out procedure, the identical high threshold is used, with movement established when the hook load exceeds the high threshold. The high dynamic threshold corresponds to the points at which the drill string actually stops and starts moving in the slips-in and slips-out procedures. The apparatus provided is a drawworks encoder mounting assembly which retrofits an auxiliary brake section of the drawworks or the rotary seal air coupler of a drawworks clutch. A split ring gear fits around and is secured to the rotating cylinder of the rotary seal air coupler. The split ring gear is part of a pulley having another gear and a drive belt, such that rotation of the drum and rotorseal air coupler cylinder is translated to a shaft of an encoder coupled to the second gear. The encoder thereby tracks the rotational movement of the drawworks drum. At desired times, also provided is a second encoder which is part of a calibrator which, via a calibrator wire, precisely measures the location of the travelling block relative to a known vertical location. The first and second encoder readings are compared continuously and are used to provide excellent calibrations between the drum rotation and the travelling block movement.

12 Claims, 5 Drawing Sheets

SYSTEM AND METHOD FOR MONITORING DRILL BIT DEPTH

BACKGROUND OF THE INVENTION

This invention relates to well drilling operations. More particularly, this invention relates to a system and method for accurately determining the depth of a drilling tool in a borehole.

The use of rotary drilling rigs in drilling oil field boreholes is presently the standard in the art. In rotary drilling, a power rotating means delivers torque to a drill pipe (a plurality of which form a "drill string") via a kelly and a rotary table. The drill pipe or string in turn rotates a bit which drills the borehole through the subsurface formations. Drill strings are supported for up and down movement by a drilling mast located at the earth's surface. A drill line (or "cable") supported to the drilling mast and coupled to the drill string is used on conjunction with a rotating drum to facilitate the up and down movement. The drill line is anchored at one end, called the dead line anchor, which is typically located adjacent a leg of the drilling mast. The drill line extends from the anchor upwardly to a crown block formed of a plurality of rotatable sheaves supported on top of the upper end of the drilling mast. The drill line is reeved about the sheaves in the crown block and extends back and forth between the sheaves of the crown block and rotating sheaves in the travelling block until the desired number of sheaves have the drill line cable received thereon. The drill line then extends from the crown block downward to the rotating drum (i.e., drawworks). The travelling block is provided with suitable means for removably connecting with the drill string such that it may suspend the drill string in the borehole, or be disconnected from the drill string as desired.

As will be appreciated by those skilled in the art, it is of great importance in the drilling of a well to know the drill bit depth, from which is usually derived the hole depth and the tool depth of measurement while drilling (MWD) tools located along the drill string (the term "MWD tools" being used in the broad sense to include logging while drilling and other measurement tools). The drill bit depth is typically determined by a combination of keeping a tally book indicating the lengths of each piece of pipe inserted onto the drill string, and by monitoring the length of drill line being let out during the drilling operation over the length of the new pipe portion. Inaccuracies often arise however. The most simple mistake is an inaccurate measurement or notation of the length of a particular pipe. Another mistake occurs during replacement of the drill bit when the drill string must be disassembled and reassembled. In reassembly, different pipes of different lengths then originally utilized might be used, or the drill stirng might be reassembled in a different order. Also, over the length of a single pipe, inaccuracies arise because the monitoring of the drill line is actually accomplished by monitoring the rotation of the drawworks. However, because the drill line cable stretches over time, and because the drill line is wound around the rotating drum in layers, the rotation of the drum is not easily correlated to the length of drill line being expended.

Further inaccuracies occur during the procedure used for adding additional pipe to the drill string. After the travelling block has moved as far as it can downward, and additional pipe must be added, the drill string is raised by reeling in the drill line cable. When the string reaches the desired height, slips are placed in the rotary table to support the drill string while the kelly is unscrewed. On a basis of a second or so, when the slips are inserted, the travelling block continues to move downward and cable is reeled out although the bit is not moving at all. The disparity in movement is due to the release of tension on the cable as the cable is no longer supporting the weight of the drill string. On the other end of the procedure, after the kelly has been unscrewed, swung over to the new pipe, the new pipe has been screwed onto the kelly, and the kelly and new pipe are swung back and attached to the drill string, the slips are removed. When the slips are removed, again misallocations regarding travelling block movement vis-a-vis drill string movement are made with resulting depth determination inaccuracies.

In order to overcome some of the inaccuracies which have been inherent in the measuring techniques, several procedures have been advocated. For example, in U.S. Pat. No. 4,114,435 to Patton et al., it was proposed to measure different travelling block reference points which related to when the cable on the drum reached different layers of unwinding, and then to determine via an equation, the reference points, the rotation of the drum, etc. the location of the travelling block. The Patton et al. patent, however, still provides inaccuracies in that (among other problems) a change of layers does not occur at an exact point but rather over an entire rotation of the drum. Moreover, as the cable ages, it stretches, an account for such a stretching is not made. Similarly, over time, the drum diameter may change due to wear and replacement of the wrapping guide grooves, and this is not accounted for by Patton et al.

A patent to Mikolajczyk, U.S. Pat. No. 4,787,244 proports to automatically determine the drill bit depth by tracking the movement of the cable. Movements of the cable are only tracked when the weight carried by the travelling block exceeds a certain minimum threshold as determined by a tensiometer on the cable. The Mikolajczyk patent, however, fails to account properly for movements of the cable during the slips in and slips out procedure when the transition is made through the threshold set by Mikolajczyk. As will be set forth below, because of the previously unknown physics of the slips in and slips out procedures, errors on the order of three to twelve inches are typically made using the Mikolajczyk procdure each time a pipe is added to the string. Similar errors are inherent in the proposed system of Chan, U.S. Pat. No. 4,616,321.

SUMMARY OF THE INVENTION

It is therefore an object of the invention to provide a method of accurately determining bit depth which overcomes the inaccuracies of the prior art.

It is another object of the invention to provide a drawworks encoder which is easily and safely retrofitted on existing drawworks and which accurately monitors the rotation of the drawworks drum.

It is a further object of the invention to provide a system which provides direct calibration and correlation between rotation of a drawworks drum and the actual displacement of a travelling block and drill string.

It is yet another object of the invention to provide a system for accurately determining bit depth which utilizes a continuous transform relating the rotation of the drawworks drum as determined by the drawworks encoder and the movement of the travelling block.

In accord with the objects of the invention, the method for accurately determining bit depth generally comprises sampling the hook load at a rate of 4 Hz or greater and storing the sampled date, comparing the sampled data to a low threshold, and then assigning a no bit movement determination retroactively to when the hook load passed through a high threshold (or the data point directly before that) before passing through the low threshold during a slips-in procedure. On the slips-out procedure, the identical high threshold is used, such that movement is established upon the hook load exceeding the high threshold. The high threshold is a dynamic threshold which is, in the preferred embodiment, approximately ninety percent of the difference between the maximum hook load and the low threshold added to the low threshold. This dynamic threshold corresponds closely to the actual movement at which the drill string and bit physically stop (and start) moving in the slips-in and slips-out procedures; such moments having not been recognized in the prior art.

While the method for accurately determining bit depth takes account of some of the previous errors of the prior art, the instant invention provides a system which accounts for others of the errors of the prior art. A drawworks encoder mounting assembly is provided which can be easily retrofit to an auxiliary brake section or the rotary seal air coupler of the drawworks. A split ring gear is fitted around the secured to the rotating cylinder of the rotory seal air coupler of the drawworks clutch means. The split ring gear is part of a pulley having another gear and a drive belt, such that the rotation of the drum and rotory seal cylinder is translated to a shaft of a quadrature incremental encoder coupled to the second gear. The encoder thereby tracks the rotational movement of the drawworks drum.

A second encoder which is part of a calibrator mechanism is also provided and at desired times a thin wire of the calibrator is attached to the travelling block. The thin wire precisely measures via the second encoder the location of the travelling block relative to a known point (i.e., the rig floor) during a calibraiton procedure. The wire of the calibrator is preferably attached to the travelling block when the travelling block has reached its maximum downward movement. Then, with the thin wire attached, the travelling block is raised upwards to its maximum height by having the drawworks reel in the cable. The readings of the first and second encoders are compared continuously during the travel of the travelling block and information derived therefrom is used to provide an excellent correlation (calibration) between the drum rotation and the travelling block movement. This calibration procedure overcomes the inaccuracies of layer overlap and stretch and wear not accounted for in the prior art. It is repeated as desired; preferably each time the cable is changed, and each time a bit is replaced.

Additional objects and advantages of the invention will become apparent to those skilled in the art upon reference to the detailed description taken in conjunction with the provided drawings.

FIGS. *6a* and *6b* are graphs over time of the hookload values over in the slips-in and slips-out transitions.

DETAILED DESCRIPTION OF THE PREFERRRED EMBODIMENT

Figure 1:
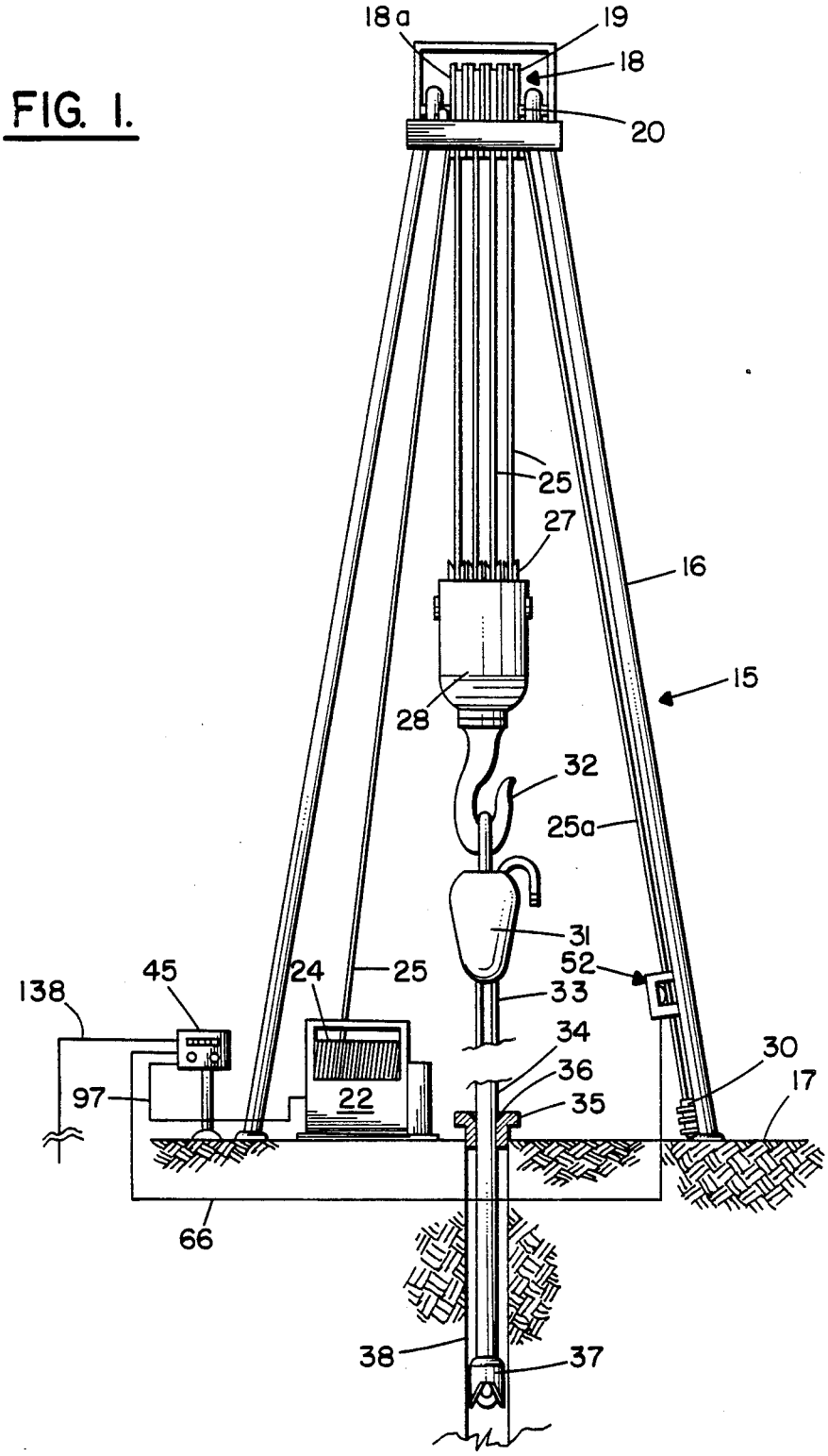
FIG. 1 is a schematic side view of a drill mast structure together with the drawworks, crown and travelling blocks, cable, and drill string, as are used in a standard oil field drilling operation.

Turning to FIG. 1, a drilling rig or drillig mast 15 of the prior art is seen. Drilling mast 15 includes legs 16 which extend upwardly from the formation 17 and carries a crown block 18 at its upper end. The crown block 18 is formed of a plurality of independently rotatable sheaves 19 carried on or supported by a shaft 20. The shaft 20 is supported on the top of the drilling mast 15. The drawworks 22 includes a powered rotatable drum 24 on which is reeved a cable 25. The cable 25 extends upwardly from the drawworks drum 24 to one of the sheaves on the crown block 18 and then extends downwardly to one of the plurality of independently rotatable sheaves 27 in the travelling block 28. The cable then continues back up to the next adjacent sheave in the crown block 18, and back down to another rotatable sheave in the travelling block, a suitable number of times until the end of the cable line is taken from a sheave of the crown block 18 and anchored by suitable means such as anchor 30. The anchor 30 may be located in any desired location, such as adjacent one of the legs 18 of the drill mast 15, or on the derrick floor substructure. The portion of the cable 25 extending from the drawworks 22 to the first sheave on crown block 18 is often called the "fast line", while that portion denoted *25a* which extends from the last sheave in the crown block 18 to the anchor 30 is termed the "deadline".

The mast, drawworks, and cable arrangement of FIG. 1 is well known to those in the oil and gas well rotary drilling arts and provides a means for conducting hoisting operations during normal drilling operations. During drilling, a device called a swivel which is schematically represented at 31 is supported on the hook 32 of the travelling block 28, and a noncircular kelly 33 is rotatably secured to the lower end of the swivel 31. The drill string 34 comprised of numerous sections of pipes is secured to the lower end of the kelly 33. Drill string 34 may contain one or more MWD tools (not shown) which are typically located near the drill bit 37 which drills the borehole 38 in the earth formation 17. This arrangement enables the rotary table 35 on the floor of the drillig mast 15 to rotate the kelly 33 and drill string 34 to cause drill bit 37 to bore.

As aforementioned, the drill string 34 is comprised of a plurality of drill pipes which are threaded and joined in end to end relation in the borehole 38 as the borehole is drilled. When it is desired to add another drill pipe to the drill string 34, the drill string 34 is raised by reeving in cable 25 on the drawworks 22 to raise the travelling block 28, the swivel 31, and the kelly 33, until the upper end of drill string 34 projects upwardly above the rotary table 35. Slips 36 are then placed in the rotary table 35 to hold and support the drill string 34. While the slips are in place, the kelly 33 is unthreaded from the upper end of the drill string 34 in a manner well known in the art. The kelly 33 which is still supported by cable 25 via hook 32 and swivel 31 is then swung over to the location of the unused pipe where the pipe threaded onto the kelly. The kelly 33 and the new pipe are then hoisted and swung back into a position such that they may be lowered and such that the new pipe may be threaded into the existing drill string 34. With the drill string reassembled, the slips 36 may be removed (i.e. "slips-out") by hoisting the entire drill string 34. The drill string which is then supported by the mast 15 may then be lowered in the borehole 38 until drill bit 37 touches bottom. The drilling process then continues. Those skilled in the art will appreciate that this operation is repeated throughout the drilling operation of the borehole. It will also be appreciated, that whenever the drill bit is replaced, the drill string 34 is disassembled and reassembled completely according to a well-known similar procedure.

Figure 2:
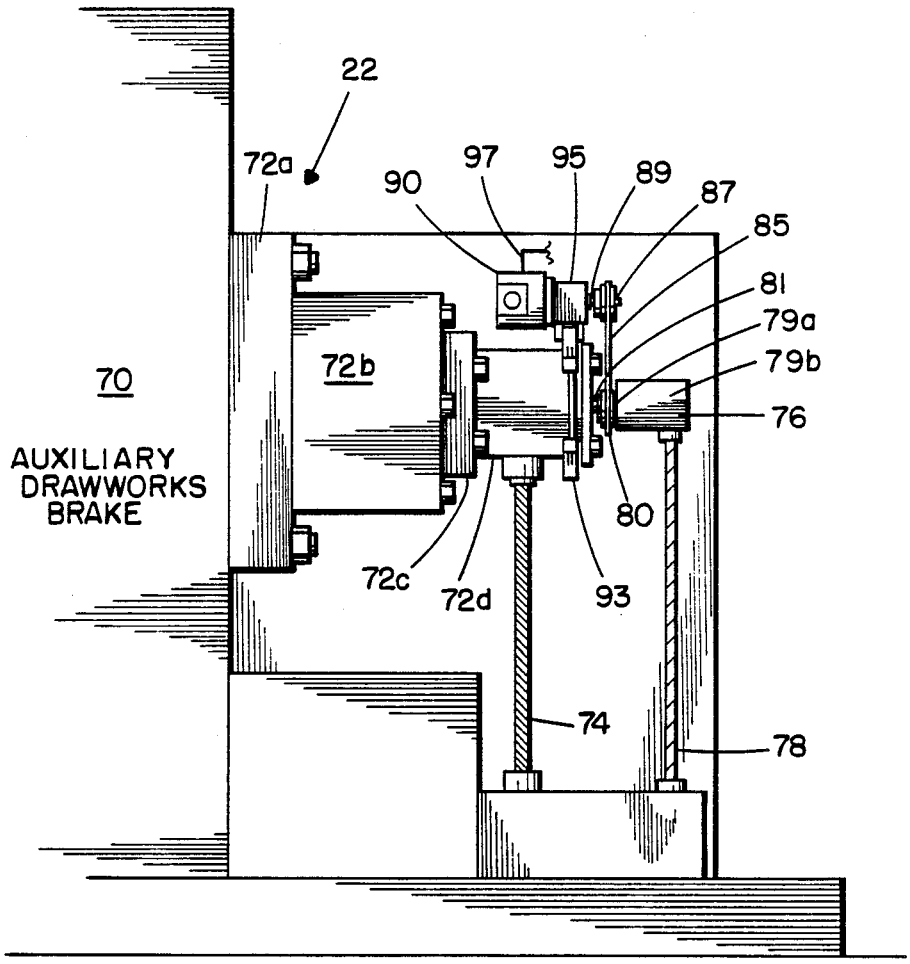
FIG. 2 is a side schematic view of an auxiliary braking section of the drawworks, together with the encoder mounting assembly of the invention.
Figure 3:
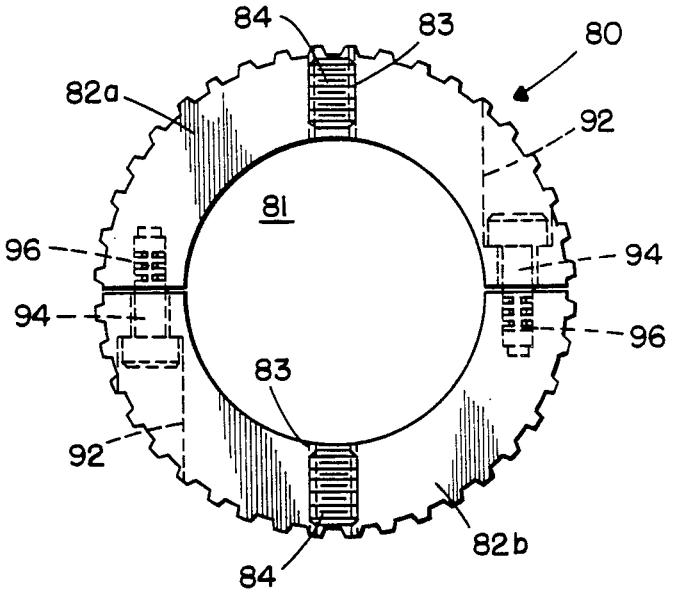
FIG. 3 is a schematic view of the split-ring pulley mechanism of the encoder mounting assembly of the invention.

It is desirable to have automatic systems and methods for continuously measuring the total depth of the drill bit on the drill string during the hoisting and drilling operations. In the past, the systems provided have not properly accounted for bit movement during the slips-in and slip-out procedure; nor have they properly calibrated travelling block movement with the drum rotation. Further, no adequate rotrofitting means have been provided for easily and accurately measuring drawworks movement. Turning to FIGS. 2 and 3, a first aspect of the invention is seen. As part of the drawworks 22, an auxiliary drawworks brake 70 is provided with various manifolds **72*a*–72*d* extending therefrom. As indicated in FIG. 2, manifold 72*d* is a water manifold, having water line 74 coupled thereto. The rotary seal coupler 76 is attached to the end of the drawworks shaft 81 which extends through manifold 72*d*. Rotory seal air coupler 76 has detachable air line 78 coupled thereto. The rotory seal air coupler also includes a portion 79*a* which rotates with the drum shaft of the drawworks, and a portion 79*b* which is stationary. In accord with the invention, a split ring pulley 80, which permits for the simple and safe attachment of an encoder which tracks the drum rotations is provided. As shown in detail in FIG. 3, the split ring pulley 80 is placed around and fastened to the exposed portion 79*a* of the rotary seal that rotates with the drum shaft 81**.

The split ring pulley 80 includes identical portions **82*a* and 82*b* which have a sunken hole 92 through which a shouldered screw 94 may pass on one side of the semicircle, and a threaded hole 96 for that threaded section on the other side of the semicircle. The identical portions 82*a* and 82*b* are placed "back to back" so that the holes align, and two screws are used to fasten the split ring pulley together over the shaft 81. Holes 83 for set screws 84 are also provided in portions 82*a* and 82*b* so that the split ring pulley can be tightly fastened onto the shaft 81**.

In a preferred embodiment, and as seen in FIG. 2, the split ring pulley 80 is formed as a gear, with teeth for engaging a drive belt 85. The shouldered screws 94 in conjunction with screws 84 are used to set gap between the two halves of the split gear, thereby insuring a proper gear tooth profile. The drive belt may be placed over the split ring pulley 80 after it is in place on the shaft 81 by disconnecting air line 78 from the rotory seal air coupler 76, and slipping the drive belt 85 over the rotory seal air coupler 76 before reattaching the air line. The drive belt 85 is used to couple the split ring pulley 80 to driven pulley or gear 87 which has the shaft 89 of a standard quadrature incremental encoder 90 coupled to it. The encoder 90 thereby tracks the rotational movement of the drawworks drum, with the ratio of movements simply determined from the gear ratio of the split ring pulley 80 and the driven pulley 87. The data gathered by encoder 90 is sent to a processor 47 via electric line 97 such that the processor can account for the movement of the drawworks drum.

The encoder 90, the encoder shaft 89, and the driven pulley 87 may be supported by the water manifold **72*d* of the auxiliary brake by using a clamp 93 and a decoupler 95. The decoupler is attached to the clamp 93 and to the encoder 90, but not to the shaft 89. By clamping clamp 93 over the manifold 72*d*, with a rigid clamp 93 and a rigid decoupler 95, the encoder 90, encoder shaft 89, and the driven pulley 87 are supported. Of course, by supplying a drive belt 85 of different size, the encoder assembly can be supported by the floor or ceiling of the drawworks housing, as desired. Also, if desired, and particularly where a water manifold is not available due to the lack of an auxiliary brake, the encoder assembly can be supported by the stationary portion 79*b* of the rotary seal housing. The rotary seal 76 will always be available as it supplies air through the shaft 81** to the clutch (not shown) of the drawworks drum.

Figure 4:
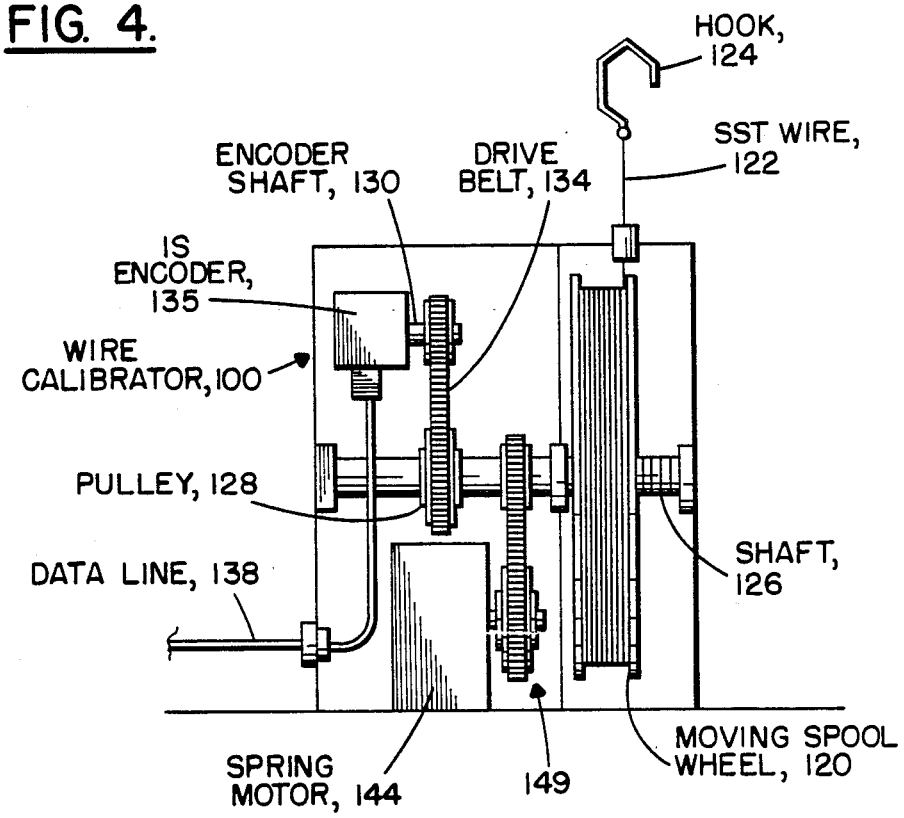
FIG. 4 is a schematic view of the wire calibrator which utilizes a second encoder in a preferred system of the invention attached to the travelling block of the system.
Figure 5:
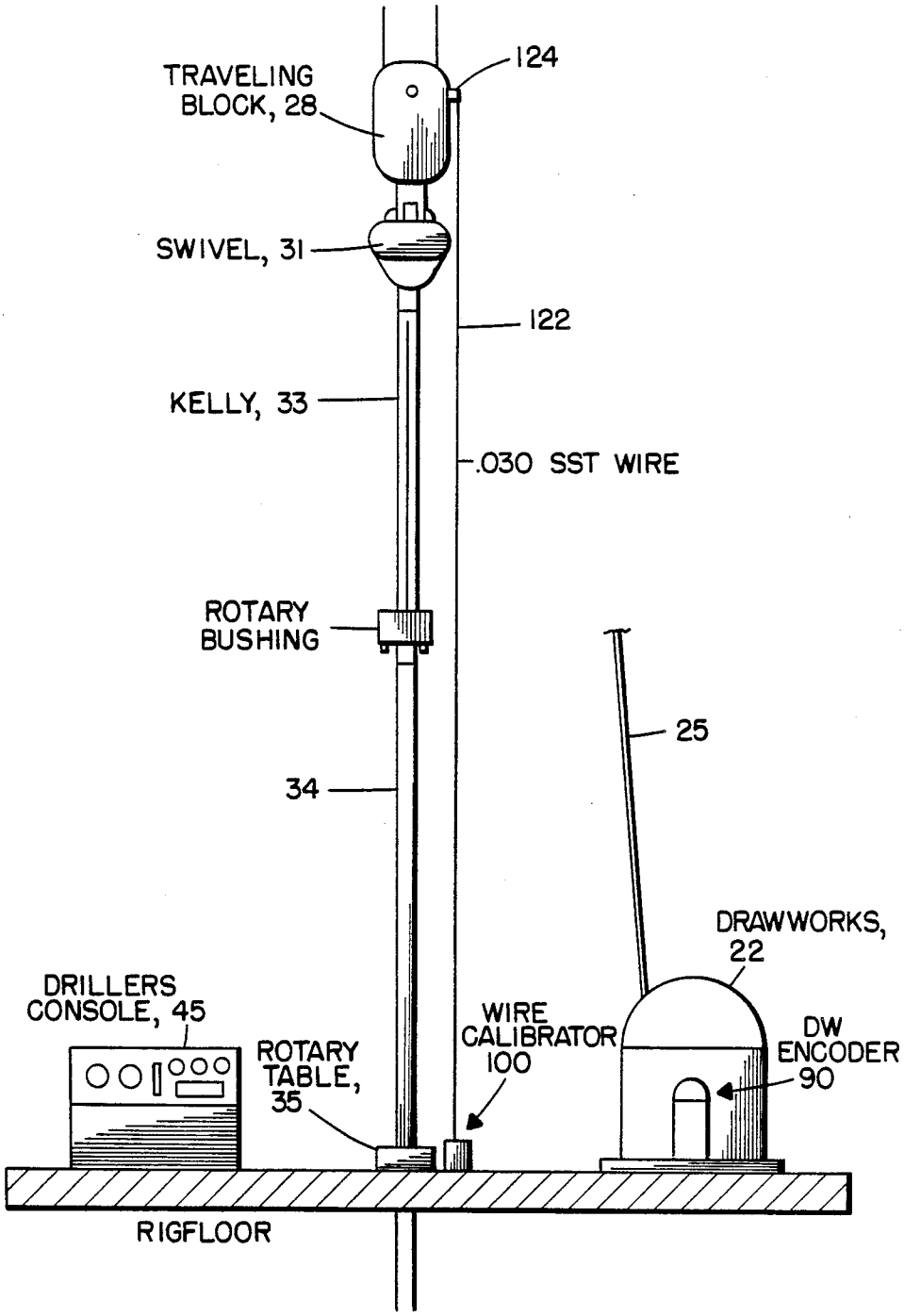
FIG. 5 is a schematic view of the wire calibrator of the invention.

With the drum shaft encoder easily installed and in place to monitor the rotation of the drum, a means and method for properly and directly calibrating drum rotation to travelling block movement is desired. Thus, in accord with a second aspect of the invention, and as seen in FIGS. 4 and 5, a calibrator 100 with a second encoder 135 is provided for measuring the distance between the travelling block 28 and a fixed point such as the rig floor or formation surface. As seen in FIG. 5, calibrator 100 has a precisely machined wheel 120 around which a thin wire 122 with low wind resistance is attached and wound in a non-overlapped manner. Thin wire 122 terminates in a loop or hook 124 so that it may be appropriately attached to the travelling block. Extending from the middle of wheel 120 is a shaft 126 around which wheel 120 rotates. Shaft 126 turns pulley 128 which in turn is connected to and turns encoder shaft 130 via belt 134. By monitoring the rotation of the encoder shaft 130, encoder 135, which may be identical to encoder 90 of FIG. 2, precisely measures the letting out (and pulling in , if desired) of wire 122. This information is forwarded by data line 138 to a computer or processor 45 (see FIGS. 1 and 4). Also provided with calibrator 100 is a drive motor mechanism 144 (such as a spring motor) for causing wire 122 to be retrieved and wound around wheel 120. The motor 144 causes rotation of shaft 126 by a belt/pulley system or gear means 149 which in turn, causes wheel 120 to rotate and reel in wire 122. Motor 144 is activated when the travelling block is lowered after completion of the calibration procedure.

In operation, the calibrator 100 is placed on and may be secured to the rig floor, and loop 124 of wire 122 is attached to elevator arms (not shown) or any other convenient part of the travelling block 28 preferably when the travelling block is at its lowest position. The calibrator 100 may be used with the kelly 33 in place, or with the kelly removed. As the drawworks 22 reels in the cable 25, data from encoders 90 and 135 are continually recorded at a computer or processor 47 until the travelling block reaches its highest position. From the received data, the processor or computer 47 creates a calibration table as desired which relates the number of pulses of encoder 90 to the distance actually travelled by the travelling block as directly measured by encoder 135. If desired, the calibration table can be complete; i.e. a distance for each pulse of encoder 90 is provided. Or, depending on the circumstances, the table can be condensed. For example, over a section of several feet where cable 25 is not changing level on the drum, the pulse/distance ratio may be nearly constant, and this constant as well as the location of cable to which the constant applies may be stored rather than original data.

Calibration with calibrator 100 is preferably performed with the travelling block supporting the string weight to most closely simulate normal drilling conditions. Experiments have shown, however, that the stretch of the line does not introduce severe errors. For example, a stretch created by a one hundred twenty-five thousand pound load creates less than a one-half inch measurement difference over a normal stand length. Also, for accuracy, a new calibration is needed every time the rig crew slips line from the reserve drum or cuts the drilling line. In fact, because of the simplicity and little time needed for conducting the calibration, a new calibration can be performed more often for maximum accuracy.

With the position of the travelling block being accurately tracked via the drawworks cable/calibrator transform, in order to precisely determine bit location, it is only necessary to know whether the drill string is moving when the travelling block is moving. A standard means for making such a determination is a clamp line tensiometer 52 (electrically connected to processor 47 via line 66) as seen in FIG. 1, which operates under the assumption that when the rig is supporting the drill string weight, all travelling block motion is also string motion. String motion can be either on-bottom motion (i.e. drilling), or off-bottom motion (i.e. tripping, reaming, moving up to make a connection, etc.) Travelling block motion without the string weight is when a new pipe is picked up and prepared for connection, or when the travelling block is repositioned during tripping.

While the clamp line tensiometer 52 of the art does function to distinguish between cable movement related to drill string movement, and cable movement where the drill string is not supported, it has been found by the inventors that substantial error is still associated with the slips-in and slips-out procedures when using clamp line tensiometers in the traditional manner. The slips-in and slips-out procedures are periods of transition which last on the order of one-quarter to one second. During slips-in and slips-out transitions, the travelling block will often move a few inches even though there is no string motion. This movement is due to the resiliency of the cable which was holding the travelling block as well as to the resiliency of the rig system. Previously, a low threshold for the clamp line tensiometer output set slightly above the block weight was used to detect the change in the slips status. Also, the sampling rate of the clamp line tensiometer output was typically 1 Hz or so. It has been determined, however, that the low sampling rate is not sufficient for making an accurate determination of when the transition from slips to hook support (or vice versa) occurs. It has also been determined that the low threshold is not properly indicative of when the transition does in fact occur.

According to a third aspect of the invention, the hookload is monitored at a rate of at least 4 Hz, and preferably at 10 Hz, and a dynamic high threshold is used as the transition point for the tensiometer for indicating that the movement of the cable corresponds to string movement. The high threshold is dynamic because the drill string gets longer and shorter (and hence the weight changes), especially while tripping. To avoid noise in the signal (e.g. string vibration), or system changes affecting the signal (e.g. weight on bit changes), the dynamic high threshold is preferably only retroactively used after the low threshold has been passed. Such a determination is easily made by processor or computer 47.

Figure 6A:
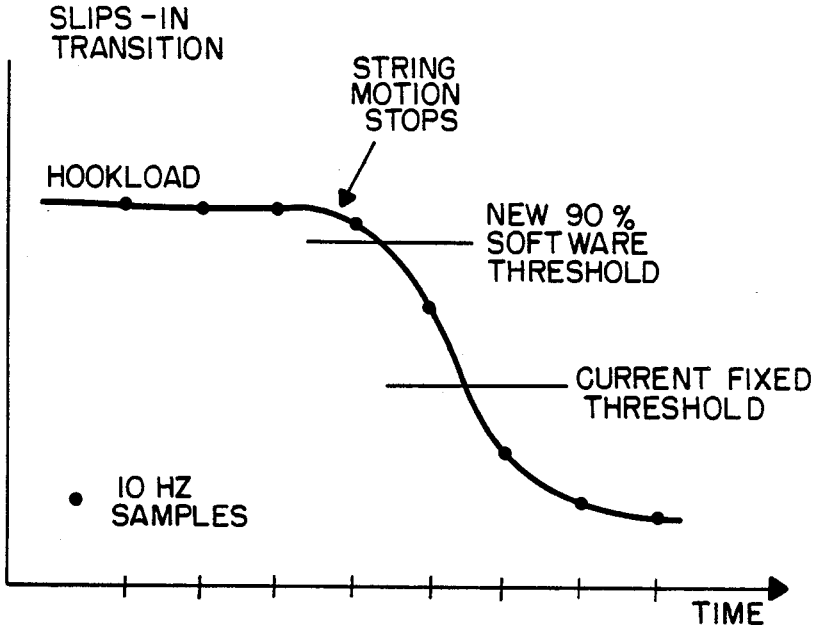
Figure 6B:
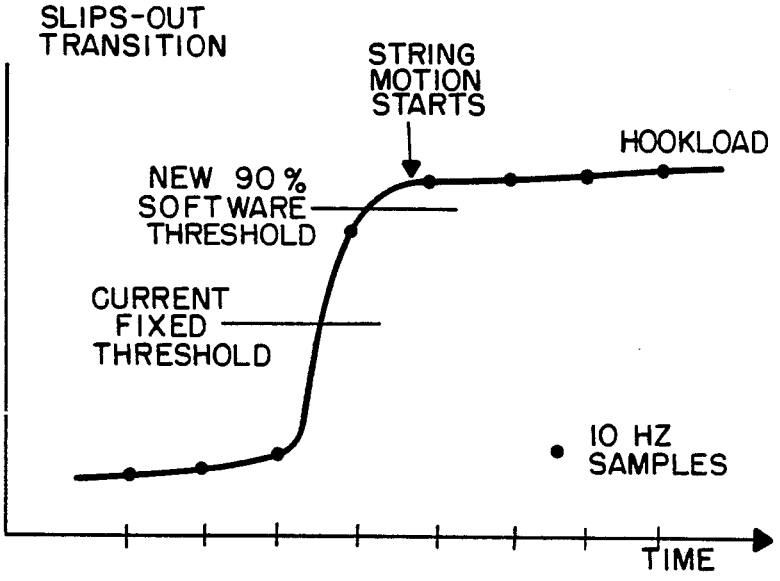

As seen in FIGS. 6*a* and 6*b* (and as determined via video frames reviewed at slow speeds), the hookloads during the slips-in and slips-out transitions appear to take a smooth transition, with curved knees located where the string motion stops and where the string motion starts. A dynamic high threshold which is equal to approximately ninety percent of the difference between the maximum hook load and the low threshold added to the low threshold (e.g. 0.9(max hook load − low threshold) + low threshold) has been found to closely approach the actual points at which the string motion stops and starts. The dynamic high threshold is preferably computed by computer 47 from a running average of the maximum hookload over a two second time period, although other time periods can be utilized. By choosing the sample point previous to the dynamic high threshold being crossed during the slips-in transition as the time at which drill string motion stopped, and the sample point directly after the dynamic high threshold being exceeded during the slips-out transition as the time at which drill string motion started, extremely accurate indications of bit depth are obtained.

If desired, rather than choosing the points directly previous to and directly after the dynamic high threshold was crossed as the string motion stop and start points, extrapolations to the dynamic high threshold or to thresholds related to the dynamic high threshold can be utilized. Of course, in order to use extrapolations, enough data points must be gathered. Therefore, the hookload must be monitored at a higher sampling rate than the previous standard. Similarly, other points, e.g. the point directly after the cross through the dynamic high threshold for the slips-on transition, and a similar point, extrapolated or not, for the slips-out transition, could be utilized. While the point directly before the high threshold for the slips-in transition, and directly after the high threshold for the slips-out transition are the preferred points to use, it should be appreciated that so long as points of substantially identical hookload are used on slips-in and slips-out, the errors regarding bit depth cancel. Thus, according to another embodiment, the slips-in and/or slips-out points may be extrapolated from known points, such that points of equal or substantially equal hookload are utilized for a determination of drill string stopping and starting. In extrapolating to points of substantially equal hookload, account may be taken of the additional weight provided by the added pipe between slips-in and slips-out, as well as the differences in friction forces. It should be noted, however, that both the weight and friction force differences are minimal in comparison to the total weights experienced.

Those skilled in the art will appreciate that with excellent knowledge of when the drill string is moving during slips-in and slips-out transitions, and with excellent knowledge of the relationship of the determinations of encoder 90 and the movement of the cable 25, improved determinations of the bit depth and hole depth are readily obtainable. Likewise, determinations of the depth of MWD tools on the drill string are also readily obtainable with increased precision.

There have been described and illustrated herein systems and methods for monitoring drill bit and hole depths. While particular embodiments have been described, it is not intended that the invention be limited thereto as it is intended that the invention be as broad in scope as the art will allow. Thus, for example, while a split-ring pulley system was described for easily retrofitting the drawworks to add an encoder, it will be appreciated that the "pulley" could take the form of any means which can be fit around the rotating portion of the rotary seal of the drawworks drum shaft itself and rotate with the drawworks drum shaft without significantly disassembling the drawworks, and which can impart that rotation to the encoder shaft. While gears and a gear chain or belt were described, it will be appreciated that depending on the type of belt used and the tension on the belt, the pulley could be e.g. a flat wheel, or a sheave. Similarly, while a calibrator including an encoder for calibrating the movement of the travelling block against the movement of the drawworks cable was described with a pulley system, it will be appreciated that other arrangements could be utilized to transfer rotation of the wheel of the calibrator to the shaft of the encoder. In fact, if desired the wheel and encoder shaft could be one and the same. It should also be appreciated that the term "wire" as used in conjunction with the calibrator is intended to be broad in scope and to include all relatively thin materials whether or metal, or natural or synthetic fiber. Also, while thresholds, tables, and the like were described as being determined and utilized by a computer or processor, it will be appreciated that the different tasks can be divided among different processors and computers which can located at different locations, if desired. Further, while the invention was described in conjunction with rotary drilling systems utilizing a kelly, it will be appreciated that the invention also applies to other systems where rotary torque is applied to a drill string, such as top drive systems. Therefore, it will be apparent to those skilled in the art that other changes and modifications may be made to the invention as described in the specification without departing from the spirit and scope of the invention as so claimed.

We claim:

1. A method for determining at least one of a borehole depth and a depth of a drilling bit in a borehole, wherein a drilling bit is coupled to the end of a drill string which in a first mode of operation is supported by a cable line reeved around at least one rotatable sheave means supported on a mast, and in a second mode is supported by other than said cable line, and wherein means for measuring hook load and means for measuring movement of said cable line are provided, said method comprising:

(a) choosing a transition threshold for said hook load, wherein when said hook load is above said threshold it is generally assumed that said drill string is moving when said cable line is moving, and when said hook is below said transition threshold it is generally assumed that said drill string is stationary even when said cable line is moving;

(b) at least during time periods corresponding to a transition from said first mode to said second mode and during a transition from said second mode to said first mode, determining with said means for measuring hook load at a rate of at least 4 Hz said hook load on said cable line to provide first mode to second mode transition samples, and second mode to first mode transition samples;

(c) in response to said first mode to second mode transition samples, and said second mode to first mode transition samples, and said transition threshold, and in conjunction with said means for measuring movement of said cable line, determining the motion of said drill string; and (d) in response to said determined motion of said drill string, determining at least one of said borehole depth and said depth of said drilling bit in said borehole.

2. A method according to claim 1, wherein:

said transition threshold is a dynamic high threshold, said dynamic high threshold being at least fifty percent of said hook load of said first mode.

3. A method according to claim 1, further comprising:

(e) choosing a second threshold for said hook load, said second threshold being substantially lower than said transition threshold, wherein said time period corresponding to said transition from said first mode to said second mode occurs only where said hook load decreases past said second threshold after decreasing past said transition threshold.

4. A method according to claim 3, wherein:

said transition threshold is a dynamic high threshold, said dynamic high threshold being at least fifty percent of said hook load of said first mode.

5. A method according to claim 4, wherein:

the drill string motion is determined at step (c) by using said first mode to second mode transition samples, and said second mode to first mode transition samples, and where said transition samples do not have values substantially equal to the hook load value of said transition threshold, extrapolating in time as to when said hook load crossed said transition threshold.

6. A method according to claim 4, wherein:

the drill string motion is determined at step (c) by using said first mode to second mode transition samples, and said second mode to first mode transition samples, and extrapolating from at least one of said first mode to second mode and second mode to first mode transition samples to provide at least one extrapolated sample having a hook load value substantially equal to a transition sample, wherein said drill string is determined to be moving when said hook load exceeds the value of said hook load of said at least one extrapolated sample rather than when said hook load exceeds the value of said transition threshold.

7. A method according to claim 4, wherein:

the drill string motion is determined at step (c) by choosing the last first mode to second mode transition sample before said hook load decreased below said transition threshold as the time at which said drill string stopped moving, and by choosing the first second mode to first mode transition sample after said hook load increased above said transition threshold as the time at which said drill string started moving.

8. A method according to claim 4, wherein:

said dynamic high threshold is approximately ninety percent of the difference of said hook load during said first mode and said second threshold, plus said second threshold.

9. A method according to claim 8, wherein:

the drill string motion is determined at step (c) by choosing the last first mode to second mode transition sample before said hook load decreased below said transition threshold as the time at which said drill string stopped moving, and by choosing the first second mode to first mode transition sample after said hook load increased above said transition threshold as the time at which said drill string started moving.

10. A method according to claim 9, wherein:

said hook load is sampled at a rate of at least 10 Hz.

11. A method according to claim 1, wherein:

the drill string motion is determined at step (c) by using said first mode to second mode transition samples, and said second mode to first mode transition samples, and where said transition samples do not have values substantially equal to the hook load value of said transition threshold, extrapolating in time as to when said hook load crossed said transition threshold.

12. A method according to claim 1, wherein:

the drill string motion is determined at step (c) by using said first mode to second mode transition samples, and said second mode to first mode transition samples, and extrapolating from at least one of said first mode to second mode and second mode to first mode samples to provide at least one extrapolated sample having a hook load substantially value equal to a transition sample, wherein said drill string is determined to be moving when said hook load exceeds the value of said hook load of said at least one extrapolated sample rather than when said hook load exceeds the value of said transition threshold.

* * * * *